US006354569B1

(12) United States Patent
Gioia

(10) Patent No.: US 6,354,569 B1
(45) Date of Patent: Mar. 12, 2002

(54) CRIBBING APPARATUS FOR STABILIZING A POST-ACCIDENT VEHICLE

(76) Inventor: Michael C. Gioia, 128 Gordon St., Ridgefield Park, NJ (US) 07660

( * ) Notice: Subject to any disclaimer, the term of this patent is extended or adjusted under 35 U.S.C. 154(b) by 0 days.

(21) Appl. No.: 09/753,509

(22) Filed: Jan. 3, 2001

(51) Int. Cl.[7] ..... B66F 3/18
(52) U.S. Cl. ..... 254/104; 254/42; 254/131
(58) Field of Search ..... 254/104, 42, 133 R, 254/93 R, 131, 98

(56) References Cited

U.S. PATENT DOCUMENTS

| | | | | | |
|---|---|---|---|---|---|
| 657,254 | A | * | 9/1900 | Slauson | 254/104 |
| 1,405,567 | A | | 2/1922 | Christensen | |
| 1,580,209 | A | | 4/1926 | McCarty | |
| 1,624,243 | A | | 4/1927 | Hoff et al. | |
| 1,923,551 | A | | 8/1933 | McCosh | |
| 2,011,933 | A | | 8/1935 | Jardim | |
| 2,028,868 | A | | 1/1936 | Jardim | |
| 4,135,335 | A | * | 1/1979 | Jensen | 254/108 |
| 4,299,347 | A | * | 11/1981 | Rougier | 254/104 |
| 4,817,224 | A | | 4/1989 | Visnaw et al. | |
| H906 | H | * | 4/1991 | Baggett et al. | 254/104 |
| 5,374,033 | A | * | 12/1994 | Tilman | 254/104 |

* cited by examiner

*Primary Examiner*—Derris H. Banks
*Assistant Examiner*—Lee Wilson
(74) *Attorney, Agent, or Firm*—Arthur Jacob

(57) ABSTRACT

Cribbing apparatus for stabilizing a post-accident vehicle against unwanted shifting of the vehicle during a rescue operation in which a victim trapped in the vehicle is to be extricated from the vehicle includes cribbing blocks hinged together for pivotal movement to fill a space between the vehicle and the ground at the site of an accident. A wedge is inserted between the pivotally connected cribbing blocks for operating the cribbing apparatus without jolts and dislocations which otherwise could cause shifting and concomitant increased danger of injury to the victim, as well as to a rescuer. A hinge includes leaves and wings in U-shaped configurations which deter skewing of the cribbing blocks during pivotal movements. The cribbing blocks include grooves for reception of the wedge such that skewing or collapse of the wedge is deterred by virtue of the confined movement of the wedge within the grooves during operation of the cribbing apparatus.

17 Claims, 5 Drawing Sheets

CRIBBING APPARATUS FOR STABILIZING A POST-ACCIDENT VEHICLE

BACKGROUND OF THE INVENTION

FIELD OF THE INVENTION

The present invention relates generally to the extrication of victims trapped in vehicles involved in accidents and pertains, more specifically, to cribbing apparatus used by rescuers to stabilize a post-accident vehicle against movement, in preparation for entry into the vehicle to remove an accident victim from the vehicle.

Each year numerous vehicles become involved in accidents on or alongside roadways, resulting in the necessity for swift action by rescue squads to extricate victims of such accidents from disabled and wrecked vehicles. Safe and effective removal of a victim from a vehicle subjected to an accident often requires that the post-accident vehicle be stabilized before entry by a rescuer so as to reduce, and advantageously eliminate, the possibility of the vehicle shifting during rescue operations, which shifting could further endanger a victim trapped in the vehicle, as well as the rescuer himself.

Cribbing apparatus is available to rescuers as a tool for stabilizing post-accident vehicles. Such cribbing apparatus usually is in the form of wooden supports which are forced into place beneath a vehicle to be stabilized, prior to entry into the vehicle. In order to effect a secure fit between the cribbing apparatus and the vehicle, and thereby establish the desired stabilization, it becomes necessary to fill any voids between the cribbing apparatus and the vehicle so as to avoid the possibility of movement of the vehicle in response to the rescue operation. In attempts to close such voids, rescuers often will jam pieces of cribbing into place; however, the force of jamming cribbing into an unwanted space can increase the risk of the vehicle shifting, with concomitant increased danger to the trapped victim in that any shift of the victim's position can cause further injury.

BRIEF SUMMARY OF THE INVENTION

The present invention avoids the necessity for the forced jamming of supplemental pieces of cribbing into place during a cribbing operation in order to fully stabilize a post-accident vehicle, and provides simple and effective cribbing apparatus for stabilizing such a vehicle for the rescue of a victim trapped in the vehicle. As such, the present invention attains several objects and advantages, some of which are summarized as follows: Provides simple and effective cribbing apparatus for rapid deployment to attain secure stabilization of a post-accident vehicle; enables positive contact with a post-accident vehicle for essentially complete stabilization without the necessity for uncontrolled jamming forces which could shift the vehicle and cause further deleterious consequences; allows stabilization of a post-accident vehicle with minimal obstruction for maximum access to a victim trapped within the vehicle; provides a compact, readily portable tool for use by rescue squads in stabilizing a post-accident vehicle; enables ease of removal of cribbing apparatus at the conclusion of a rescue operation; provides relatively inexpensive cribbing apparatus so as to be readily available to a greater number of rescuers for more widespread use; provides rugged cribbing apparatus capable of exemplary performance over a long service life.

The above objects and advantages, as well as further objects and advantages, are attained by the present invention which may be described briefly as cribbing apparatus for placement at selected locations at a site of an accident to stabilize a post-accident vehicle against unwanted shifting on ground located at the accident site during rescue of a victim trapped in the vehicle, the cribbing apparatus comprising: a first cribbing block having a forward end, a rearward end spaced longitudinally from the forward end, an upper surface, and a lower surface spaced altitudinally from the upper surface; a second cribbing block having a forward end, a rearward end spaced longitudinally from the forward end, an upper surface, and a lower surface spaced altitudinally from the upper surface; a hinge connecting the first and second cribbing blocks at the respective forward ends, with the lower surface of the first cribbing block confronting the upper surface of the second cribbing block, the hinge allowing selective pivotal movement of the cribbing blocks relative to one another about a lateral axis for selectively moving the respective rearward ends from a first position wherein the rearward ends are contiguous with one another, to a second position wherein the rearward ends are spaced altitudinally from one another; and a wedge for insertion between the lower surface of the first cribbing block and the upper surface of the second cribbing block, the wedge having an upper edge, a lower edge, a forward tip and a rearward end, and being moveable in longitudinal directions, the wedge further having a drive angle between the upper edge and the lower edge for effecting movement of the respective rearward ends of the cribbing blocks relative to one another between the first and second positions to fill a space between the vehicle and the ground at the selected location, thereby stabilizing the vehicle for a rescue operation at the accident site.

BRIEF DESCRIPTION OF THE SEVERAL VIEWS OF THE DRAWING

The invention will be understood more fully, while still further objects and advantages will become apparent, in the following detailed description of preferred embodiments of the invention illustrated in the accompanying drawing, in which.

DETAILED DESCRIPTION OF THE INVENTION

Figure 1:
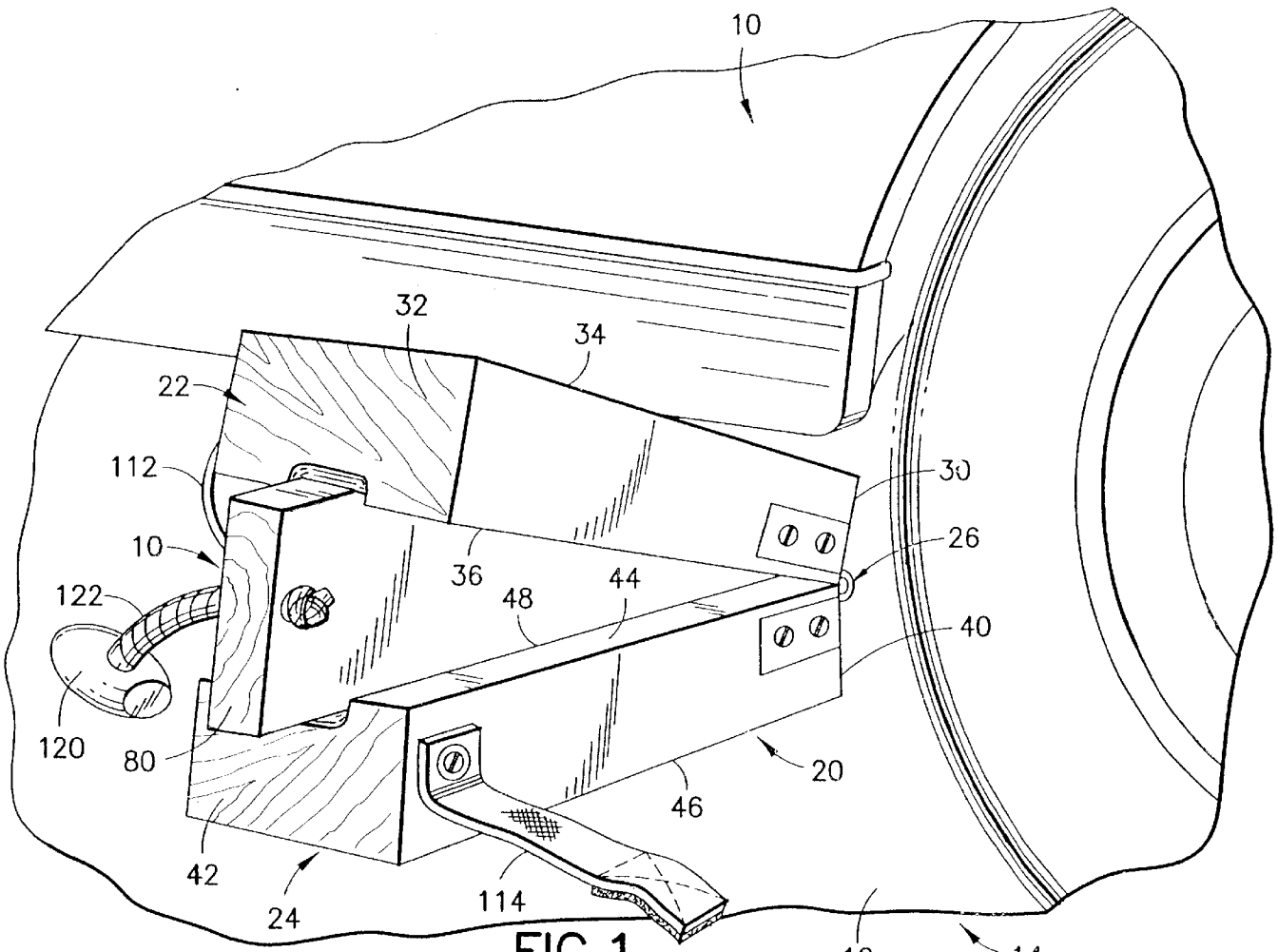
FIG. 1 is a fragmentary pictorial perspective view showing a post-accident vehicle stabilized with cribbing apparatus constructed in accordance with the present invention.

Referring now to the drawing, and especially to FIG. 1 thereof, a post-accident vehicle 10 is shown stabilized against unwanted movement relative to ground 12 at site 14 of an accident which has disabled the vehicle 10 and has trapped a victim (not shown) within the vehicle. In order to enable a rescuer (not shown) to enter the vehicle 10 and extricate the injured victim without subjecting the victim to possible further injury, the vehicle 10 has been stabilized against deleterious shifting by the placement beneath the vehicle of cribbing apparatus 20 constructed in accordance with the present invention. Cribbing apparatus 20 is firmly secured between the vehicle 10 and the ground 12, usually at several locations spaced around the vehicle 10, so as to preclude relative movement between the vehicle 10 and the ground 12 during rescue operations.

Figure 2:
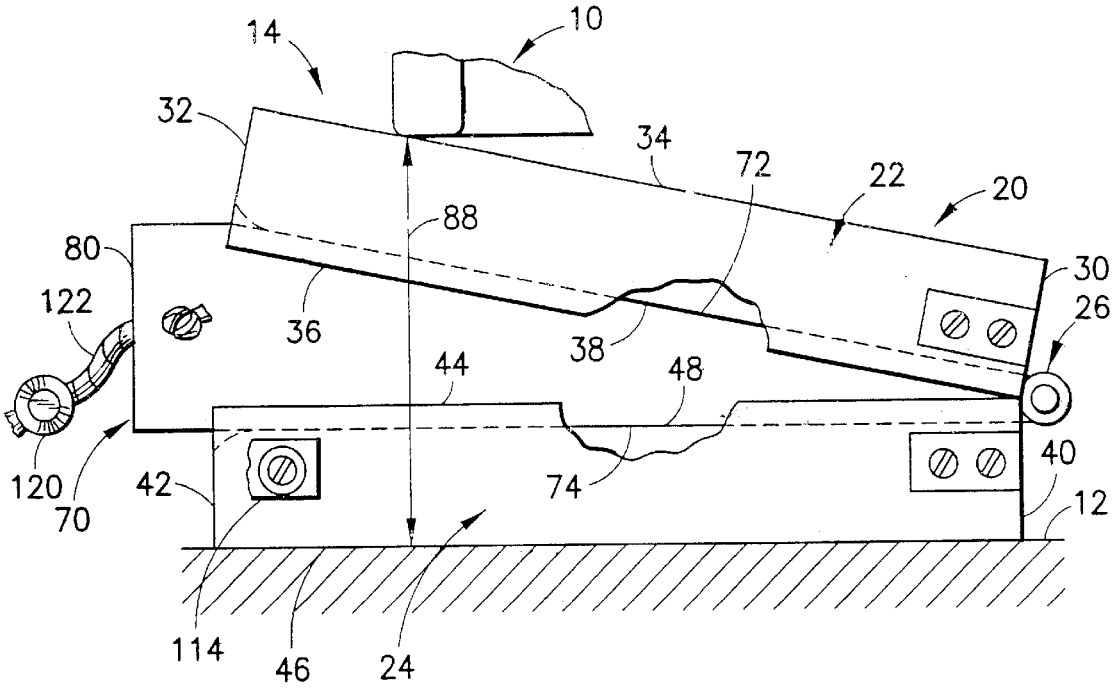
FIG. 2 is a side elevational view of the cribbing apparatus in an erect configuration, as in FIG. 1.
Figure 3:
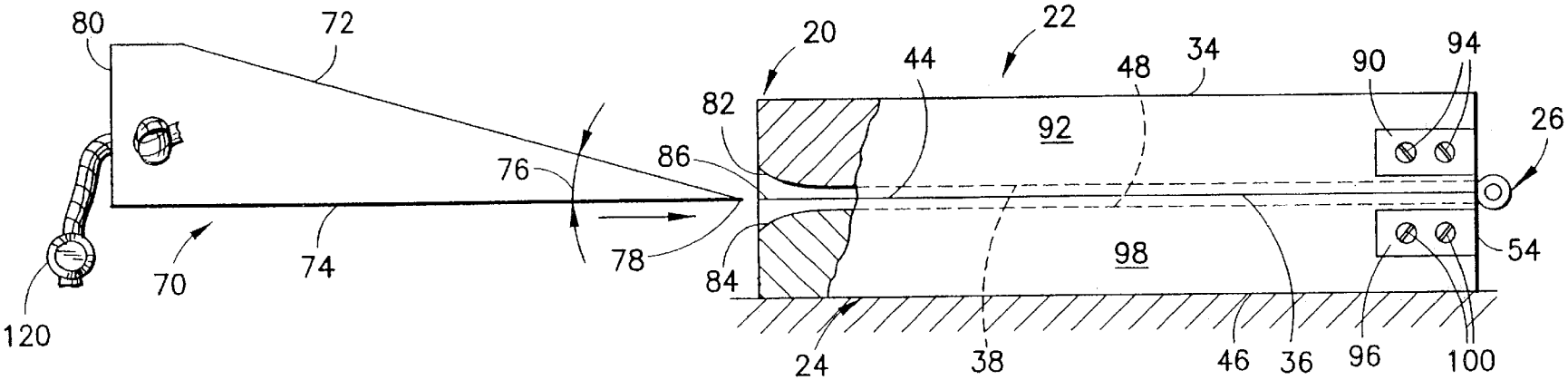
FIG. 3 is a side elevational view of the cribbing apparatus in a collapsed configuration.

In order to assure the firm securement of cribbing apparatus 20 in place, as illustrated, cribbing apparatus 20 is provided with a first, or upper cribbing block 22 and a second, or lower cribbing block 24, hinged together by a hinge 26 for movement relative to one another between an erect configuration, as seen in FIGS. 1 and 2, and a collapsed configuration, illustrated in FIGS. 3 through 6. Upper cribbing block 22 is generally parallelepipedonal and has a longitudinal length between a forward end 30 and a rearward end 32 spaced longitudinally from the forward end 30. An upper surface 34 is spaced altitudinally from a lower surface 36 of the upper cribbing block 22, and a groove 38 extends longitudinally along the upper cribbing block 22 at the lower surface 36. Likewise, lower cribbing block 24 is generally parallelepipedonal and has a longitudinal length between a forward end 40 and a rearward end 42 spaced longitudinally from the forward end 40. An upper surface 44 is spaced altitudinally from a lower surface 46 of the lower cribbing block 24, and a groove 48 extends longitudinally along the lower cribbing block 24 at the upper surface 44. Cribbing blocks 22 and 24 advantageously are constructed of wood; however, those skilled in the art of materials will recognize that suitable synthetic polymeric materials are available for the construction of cribbing blocks 22 and 24.

Hinge 26 includes an upper leaf 50 affixed to forward end 30, as by threaded fasteners 52, and a lower leaf 54 affixed to forward end 40, as by threaded fasteners 56. A hinge pin 58 extends along a lateral axis 60 and allows pivotal movement of the upper and lower cribbing blocks 22 and 24 relative to one another between the collapsed configuration illustrated in FIG. 3, wherein the lower surface 36 of the upper cribbing block 22 is juxtaposed and is contiguous with the upper surface 44 of the lower cribbing block 24, and the erect position illustrated in FIGS. 1 and 2, wherein the lower surface 36 confronts the upper surface 44, with the upper and lower surfaces 44 and 36 spaced altitudinally away from one another.

A wedge 70 has an upper edge 72 complementary to groove 38 so as to be received for sliding movement confined within groove 38, and a lower edge 74 complementary to groove 48 for sliding reception within groove 48. Upper and lower edges 72 and 74 diverge from one another at a drive angle 76, from a forward tip 78 toward a rearward end 80. Upon insertion of the wedge 70 into the grooves 38 and 48, forward movement of the wedge 70 within the grooves 38 and 48 will raise the upper cribbing block 22 to move the rearward end 32 of the upper cribbing block 22 from a first, or lower position where the rearward end 32 is contiguous with the rearward end 42 of the lower cribbing block 24, to a second, or upper position where the rearward end 32 of the upper cribbing block 22 is raised from the rearward end 42 of the lower cribbing block 24 so that the rearward ends 32 and 42 are spaced altitudinally from one another. Groove 38 is flared at 82 and groove 48 is flared at 84 to facilitate insertion of the tip 78 of the wedge 70 into entrance 86 of the juxtaposed, contiguous grooves 38 and 48 for forward movement of the wedge 70 between the upper and lower cribbing blocks 22 and 24. The preferred magnitude of drive angle 76 is about 15°. Suitable materials for wedge 70 are wood and various synthetic polymeric materials.

In use, a cribbing apparatus 20, in the collapsed configuration, is placed beneath the post-accident vehicle 10 at selected locations chosen by rescuers for bracing the vehicle 10 against unwanted movement during extrication of the trapped victim. With the cribbing apparatus 20 in the collapsed configuration, sufficient clearance is available to position cribbing apparatus 20 in optimum locations without disturbing the position of the post-accident vehicle 10. Once having positioned cribbing apparatus 20 at the optimum locations, wedge 70 is inserted into the juxtaposed grooves 38 and 48 and is moved forward, in the direction of the arrow in FIG. 3, to move the rearward ends 32 and 42 away from the lower position and toward the upper position, thereby raising the upper cribbing block 22 away from the lower cribbing block 24 to move the cribbing blocks 22 and 24 from the collapsed configuration toward the erect configuration. In this manner, the spacing 88 between the post-accident vehicle 10 and the ground 12 at the accident site 14 is filled fully and expeditiously, and with a controlled wedging action to establish stabilizing support for preventing shifting of the position of the vehicle 10 without the use of uncontrolled jamming forces which could disturb the position of the post-accident vehicle, allowing the vehicle 10 to shift, with a concomitant increase in the danger of causing further injury to the trapped victim, as well as to the rescuer.

The construction of hinge 26 deters any tendency toward skewing of the upper and lower cribbing blocks 22 and 24 relative to one another as the cribbing blocks 22 and 24 are moved away from one another, thereby assuring a smooth and effective bracing operation, without jolts and dislocations which could cause shifts and further injuries. Thus, upper leaf 50 includes integral wings 90, preferably unitary with leaf 50, which extend along laterally opposite sides 92 of the upper cribbing block 22 and are affixed to the upper cribbing block 22, as by threaded fasteners 94 which extend essentially perpendicular to threaded fasteners 52. Likewise, lower leaf 54 includes integral wings 96, preferably unitary with lower leaf 54, which extend along laterally opposite sides 98 of the lower cribbing block 24 and are affixed to the lower cribbing block 24, as by threaded fasteners 100 which extend essentially perpendicular to threaded fasteners 56. The resulting U-shaped configuration of the respective combined leaves 50, 54 and wings 90, 96, fastened to the corresponding cribbing blocks 22 and 24 by threaded fasteners 52, 56, and perpendicular fasteners 94, 100, reinforces the cribbing blocks 22 and 24 against deleterious skewing relative to one another while the cribbing apparatus bears the load imposed by stabilizing the post-accident vehicle 10. By guiding the wedge 70 within grooves 38 and 48, wedge 70 accomplishes the desired pivotal movement of the cribbing blocks 22 and 24 relative to one another without any collapse or skewing of the wedge 70 which could enable deleterious jolts and dislocations.

Figure 4:
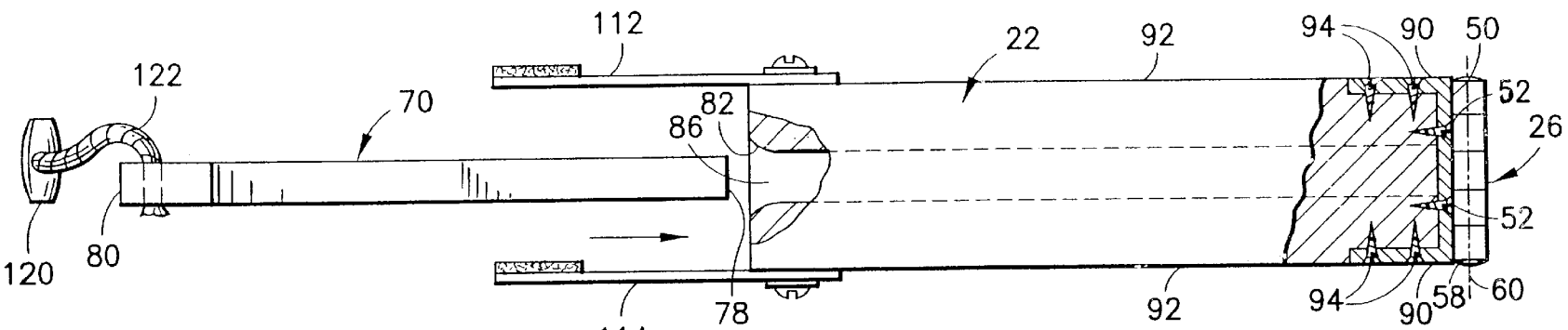
FIG. 4 is a top plan view of the cribbing apparatus in the collapsed configuration.
Figure 5:
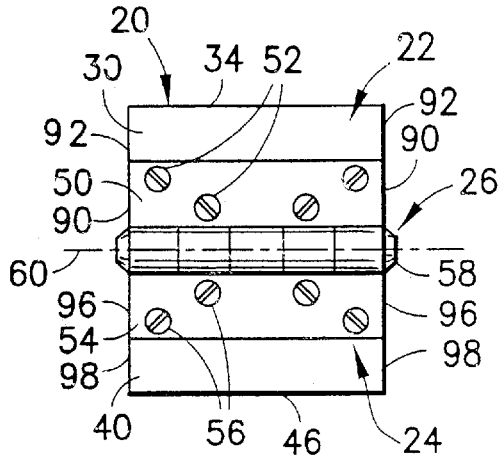
FIG. 5 is a forward end elevational view of the cribbing apparatus.
Figure 6:
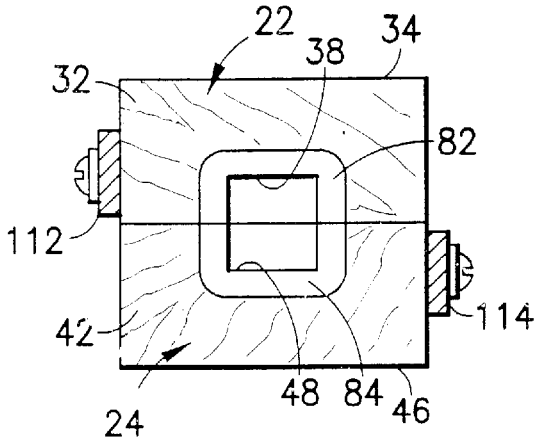
FIG. 6 is a rearward end elevational view of the cribbing apparatus.
Figure 7:
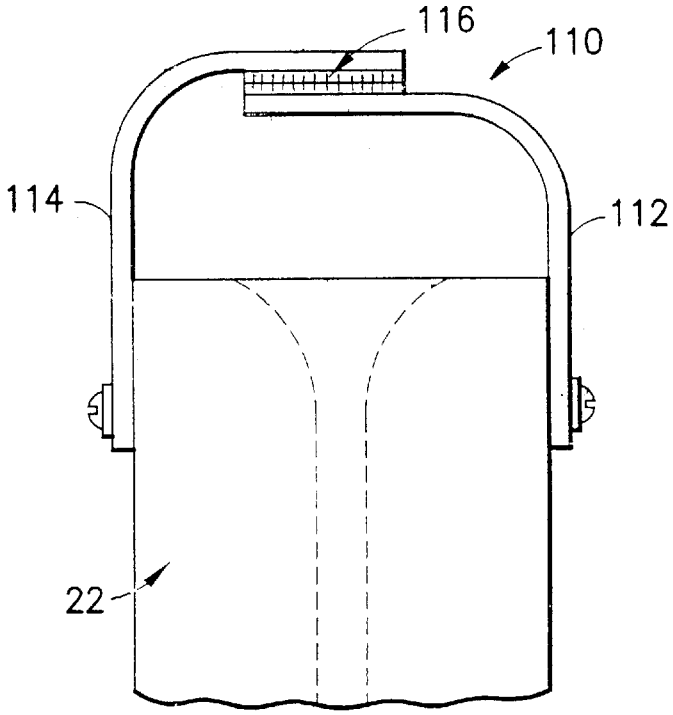
FIG. 7 is an enlarged fragmentary top plan view of the cribbing apparatus.

Referring to FIG. 7, as well as to FIGS. 1 through 6, cribbing apparatus 20 is carried conveniently to the accident site 14 by means of a carrying strap 110 having a first segment 112 secured to the upper cribbing block 22, adjacent the rearward end 32, and a second segment 114 secured to the lower cribbing block 24, adjacent the rearward end 42. A selectively detachable fastener, such as a hook-and-loop fastener 116 selectively fastens together the segments 112 and 114 for ease of carrying, with the cribbing apparatus 20 retained in the collapsed configuration, while allowing selective separation of the segments 112 and 114 to free the cribbing blocks 22 and 24 for pivotal movement relative to one another and allow access to the grooves 38 and 48 by the wedge 70, as seen in FIG. 4, for movement into the erect configuration of the cribbing apparatus 20. A handle 120 is attached to the wedge 70, adjacent the rearward end 80, by means of a short tether 122, for assisting in manipulation of the wedge 70, and especially in pulling the wedge 70 for withdrawal of the wedge 70 from between the cribbing blocks 22 and 24 upon completion of the rescue operation.

Figure 8:
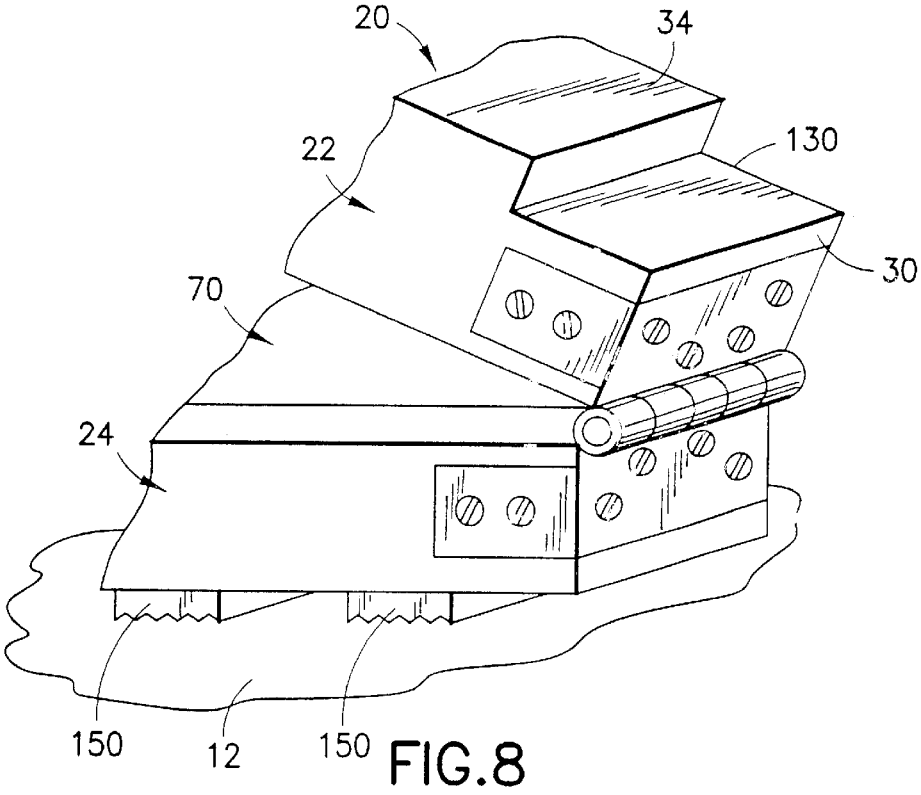
FIG. 8 is a fragmentary perspective view of an alternate configuration.
Figure 9:
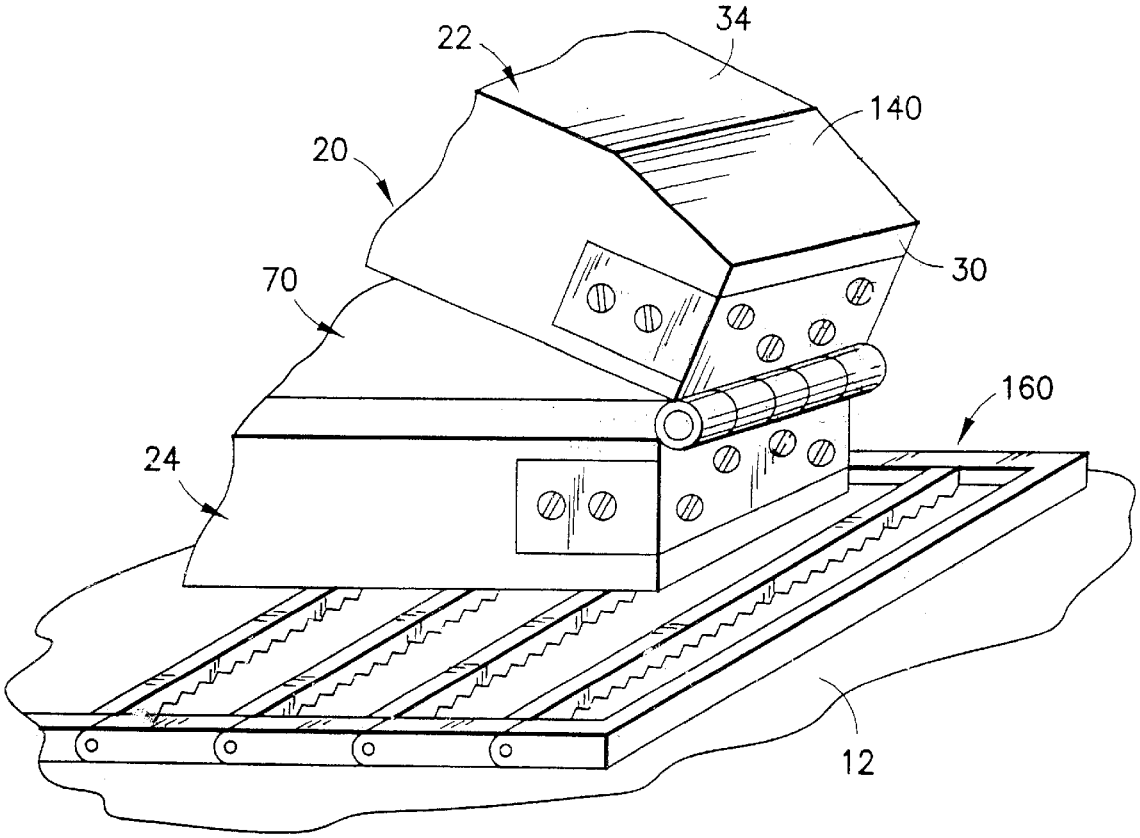
FIG. 9 is a fragmentary perspective view of another alternate configuration.

Turning now to the embodiments of FIGS. 8 and 9, in order to clear various structural features found in different vehicles, upper surface 34 of upper cribbing block 22 may be provided with a clearance structure, such as step 130, as seen in FIG. 8, or a taper 140, as seen in FIG. 9, adjacent the forward end 30, in order to facilitate location of the cribbing apparatus 20 well beneath the post-accident vehicle 10 at almost any selected location. Where the ground 12 is wet or slippery, the lower surface 46 of the lower cribbing block 24 may be provided with cleats 150, as illustrated in FIG. 6, for a better grip on the ground 12. Alternately, a skid-resistant mat 160 may be placed beneath the cribbing apparatus 20, as seen in FIG. 9, especially where the ground 12 is covered with snow or ice.

It will be seen that the present invention attains all of the objects and advantages summarized above, namely: Provides simple and effective cribbing apparatus for rapid deployment to attain secure stabilization of a post-accident vehicle; enables positive contact with a post-accident vehicle for essentially complete stabilization without the necessity for uncontrolled jamming forces which could shift the vehicle and cause further deleterious consequences; allows stabilization of a post-accident vehicle with minimal obstruction for maximum access to a victim trapped within the vehicle; provides a compact, readily portable tool for use by rescue squads in stabilizing a post-accident vehicle; enables ease of removal of cribbing apparatus at the conclusion of a rescue operation; provides relatively inexpensive cribbing apparatus so as to be readily available to a greater number of rescuers for more widespread use; provides rugged cribbing apparatus capable of exemplary performance over a long service life.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A cribbing apparatus for placement at selected locations at a site of an accident to stabilize a post-accident vehicle against unwanted shifting on ground located at the accident site during rescue of a victim trapped in the vehicle, the cribbing apparatus comprising:

a first cribbing block having a forward end, a rearward end spaced longitudinally from the forward end, an upper surface, and a lower surface spaced altitudinally from the upper surface;

a second cribbing block having a forward end, a rearward end spaced longitudinally from the forward end, an upper surface, and a lower surface spaced altitudinally from the upper surface;

a hinge connecting the first and second cribbing blocks at the respective forward ends, with the lower surface of the first cribbing block confronting the upper surface of the second cribbing block, the hinge allowing selective pivotal movement of the cribbing blocks relative to one another about a lateral axis for selectively moving the respective rearward ends from a first position wherein the rearward ends are contiguous with one another, to a second position wherein the rearward ends are spaced altitudinally from one another; and a wedge for insertion between the lower surface of the first cribbing block and the upper surface of the second cribbing block, the wedge having an upper edge, a lower edge, a forward tip and a rearward end, and being moveable in longitudinal directions, the wedge further having a drive angle between the upper edge and the lower edge for effecting movement of the respective rearward ends of the cribbing blocks relative to one another between the first and second positions to fill a space between the vehicle and the ground at the selected location, thereby stabilizing the vehicle for a rescue operation at the accident site.

2. The cribbing apparatus of claim 1 wherein the drive angle is about 15°.

3. The cribbing apparatus of claim 1 including a groove in the first cribbing block and extending longitudinally along the lower surface of the first cribbing block for reception of the upper edge of the wedge, the groove being complementary to the upper edge of the wedge for deterring skewing of the wedge as the wedge is moved longitudinally along the first cribbing block.

4. The cribbing apparatus of claim 3 wherein the groove is flared at the rearward end of the first cribbing block for facilitating reception of the wedge within the groove.

5. The cribbing apparatus of claim 1 including a groove in the second cribbing block and extending longitudinally along the upper surface of the second cribbing block for reception of the lower edge of the wedge, the groove being complementary to the lower edge of the wedge for deterring skewing of the wedge as the wedge is moved longitudinally along the second cribbing block.

6. The cribbing apparatus of claim 5 wherein the groove is flared at the rearward end of the second cribbing block for facilitating reception of the wedge within the groove.

7. The cribbing apparatus of claim 1 including:

a first groove in the first cribbing block and extending longitudinally along the lower surface of the first cribbing block for reception of the upper edge of the wedge, the first groove being complementary to the upper edge of the wedge for deterring skewing of the wedge as the wedge is moved longitudinally along the first cribbing block; and a second groove in the second cribbing block and extending longitudinally along the upper surface of the second cribbing block for reception of the lower edge of the wedge, the second groove being complementary to the lower edge of the wedge for deterring skewing of the wedge as the wedge is moved longitudinally along the second cribbing block.

8. The cribbing apparatus of claim 7 wherein:

the first groove is flared at the rearward end of the first cribbing block for facilitating reception of the wedge within the first groove; and the second groove is flared at the rearward end of the second cribbing block for facilitating reception of the wedge within the second groove.

9. The cribbing apparatus of claim 8 wherein the drive angle is about 15°.

10. The cribbing apparatus of claim 1 wherein the first cribbing block includes laterally opposite sides, and the hinge includes a leaf affixed to the forward end of the first cribbing block, and wings integral with the leaf and affixed to the laterally opposite sides of the first cribbing block for deterring skewing of the first cribbing block relative to the second cribbing block as the rearward ends are moved between the first and second positions.

11. The cribbing apparatus of claim 10 wherein the leaf and the wings form a generally U-shaped configuration.

12. The cribbing apparatus of claim 1 wherein the second cribbing block includes laterally opposite sides, and the hinge includes a leaf affixed to the forward end of the second cribbing block, and wings integral with the leaf and affixed to the laterally opposite sides of the second cribbing block for deterring skewing of the second cribbing block relative to the first cribbing block as the rearward ends are moved between the first and second positions.

13. The cribbing apparatus of claim 12 wherein the leaf and the wings form a generally U-shaped configuration.

14. The cribbing apparatus of claim 1 wherein:

the first cribbing block includes laterally opposite first sides, and the hinge includes a first leaf affixed to the forward end of the first cribbing block, and first wings integral with the first leaf and affixed to the laterally opposite first sides of the first cribbing block for deterring skewing of the first cribbing block relative to the second cribbing block as the rearward ends are moved between the first and second positions; and the second cribbing block includes laterally opposite second sides, and the hinge includes a second leaf affixed to the forward end of the second cribbing block, and second wings integral with the second leaf and affixed to the laterally opposite second sides of the second cribbing block for deterring skewing of the second cribbing block relative to the first cribbing block as the rearward ends are moved between the first and second positions.

15. The cribbing apparatus of claim 14 wherein:

the first leaf and the first wings form a first generally U-shaped configuration; and the second leaf and the second wings form a second generally U-shaped configuration.

16. The cribbing apparatus of claim 1 including a carrying strap secured to the rearward end of each of the first and second cribbing blocks, the carrying strap having a first segment secured adjacent the rearward end of the first cribbing block, a second segment secured adjacent the rearward end of the second cribbing block, and a selective fastener for selectively connecting the first and second segments to one another for facilitating carrying the cribbing apparatus, and for selectively disconnecting the first and second segments from one another for facilitating insertion of the wedge between the first and second cribbing blocks.

17. The cribbing apparatus of claim 1 including a handle attached adjacent the rearward end of the wedge for facilitating pulling of the wedge for withdrawal of the wedge from between the first and second cribbing blocks.

* * * * *